US007229104B2

(12) United States Patent
Hsu

(10) Patent No.: US 7,229,104 B2
(45) Date of Patent: Jun. 12, 2007

(54) SHRINKAGE-FREE SEALING STRUCTURE OF HEAT PIPE

(76) Inventor: Hul- Chun Hsu, 6F-3, No. 422, Sec. 2 Lin Ming Rd., Taichung (TW)

( * ) Notice: Subject to any disclaimer, the term of this patent is extended or adjusted under 35 U.S.C. 154(b) by 161 days.

(21) Appl. No.: 10/770,473

(22) Filed: Feb. 4, 2004

(65) Prior Publication Data

US 2005/0167984 A1 Aug. 4, 2005

(51) Int. Cl.
*F16L 13/14* (2006.01)

(52) U.S. Cl. ..... 285/382; 165/104.26

(58) Field of Classification Search ..... 285/382, 285/286.2, 288.1

See application file for complete search history.

(56) References Cited

U.S. PATENT DOCUMENTS 3,680,189 A * 8/1972 Noren ..... 29/890.032
4,007,781 A * 2/1977 Masters ..... 165/46
6,463,911 B1 * 10/2002 Treusch et al. ..... 123/467
6,568,370 B1 * 5/2003 Treusch et al. ..... 123/467
6,725,910 B2 * 4/2004 Ishida et al. ..... 165/104.26
6,830,098 B1 * 12/2004 Todd et al. ..... 165/104.33
6,871,635 B2 * 3/2005 Curran et al. ..... 123/456
6,883,594 B2 * 4/2005 Sarraf et al. ..... 165/104.33
6,957,691 B2 * 10/2005 Hsieh ..... 165/104.26

* cited by examiner

*Primary Examiner*—David Bochna

(57) ABSTRACT

A shrinkage-free sealing structure of a heat pipe. The sealing structure is in the form of a double-layered structure formed by transversely pressing a first side of an open end of the heat pipe towards a second side of the open end and transversely pressing the second side towards the first side. Preferably, the double-layered structure has a semi-circular cross section after the first side is pressed towards the second side of the open end, and the sealing structure has an arrowhead structure after the second side is pressed towards the first side.

5 Claims, 8 Drawing Sheets

SHRINKAGE-FREE SEALING STRUCTURE OF HEAT PIPE

BACKGROUND OF THE INVENTION

The present invention relates to a shrinkage-free sealing structure of a heat pipe, and more particular, to a method which seals one open end of a heat pipe without performing shrinkage process thereof.

For the majority of electronic products, the performance depends on the operation processing speed, while the heat dissipation is a consequence of the operation processing speed. In the example of a central processing unit (CPU) of a computer motherboard, transmission of various command signals and calculation program parameters are performed with very high speed to generate significant heat. The heat adversely affects the performance and reduces the operation speed of the central processing unit. The operation may even be halted when the central processing unit is over heated. Therefore, heat dissipation devices are required to keep the electronic products working under a tolerable temperature range to avoid interruption or termination of operation.

To enhance heat dissipation efficiency, highly thermal conductive heat pipes operative to absorb and dissipate heat efficiency have been used in the heat dissipation devices. A heat pipe is in the form of a tube with one closed end and one open end. A wick structure is installed in the heat pipe and a working fluid is introduced into the heat pipe, followed by the process of sealing the open end. When the heat pipe is in contact with the electronic products, the heat absorbing end absorbs the heat from the electronic products, such that a phase transition from the liquid state to the gas state occurs to the working fluid. After flowing to the cooling end of the heat pipe, the gaseous working fluid is then condensed back to the liquid state and re-flows back to the heat absorbing end by the capillary effect provided by the wick structure. Therefore, the circulation and phase transition of the working fluid irritated in the heat pipe provides enhanced heat dissipation performance, such that the electronic product can always operate under a uniform and working temperature To ensure the quality and functionality of the heat pipe, the sealed end of the heat pipe is further subject to a soldering process. As shown in FIG. 1, the conventional sealing structure of a heat pipe is performed by shrinking the open end portion of the heat pipe 10*a* into a shrunk end portion 100*a*, and a sealing module is used to clamp the terminus of the shrunk end portion 100*a*, such that a flattened region 101*a* is formed. The edge of the flattened region 101*a* is then soldered to ensure a air-tight sealing effect.

However, the objective for shrinking the end portion 10*a* into the shrunk end portion 100*a* is to decrease the volume and area of the sealing structure, such that it is advantageous for the subsequent soldering process. However, as the shape of the wick structure proximal to the shrunk end portion 10*a* is unstable, the working fluid has to be filled manually. Therefore, the fabrication process is laborious and costly. The wick structure installed and the working fluid filled after the shrunk end portion 100*a* is formed will become very difficult.

To resolve the problems caused by the conventional heat pipe structure as described above, the Applicant, with many years of experience in this field, has developed a shrinkage-free sealing structure of heat pipe as described as follows

BRIEF SUMMARY OF THE INVENTION

The present invention provides a shrinkage-free sealing structure of a heat pipe to resolve the problems of the conventional sealing structure and to reduce the cost, and the soldering process of the sealing structure is easier compared to the conventional structure.

The shrinkage-free sealing structure of a heat pipe provided by the present invention comprises a double-layered structure formed by transversely pressing a first side of an open end of the heat pipe towards a second side of the open end for at least once and transversely pressing the second side towards the first side for at least once. Preferably, the double-layered structure has a semi-circular cross section after the first side is pressed towards the second side of the open end, and the sealing structure has an arrowhead structure after the second side is pressed towards the first side.

These and other objectives of the present invention will become obvious to those of ordinary skill in the art after reading the following detailed description of preferred embodiments.

It is to be understood that both the foregoing general description and the following detailed description are exemplary, and are intended to provide further explanation of the invention as claimed.

BRIEF DESCRIPTION OF THE DRAWINGS

These, as well as other features of the present invention, will become apparent upon reference to the drawings wherein.

DETAILED DESCRIPTION OF THE INVENTION

Figure 1:
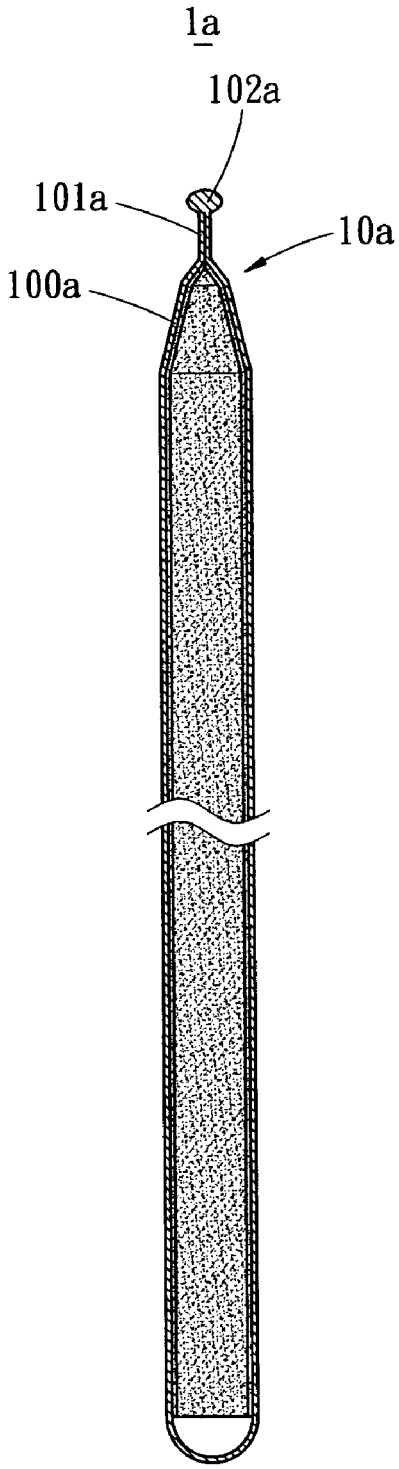
FIG. 1 PRIOR ART
FIG. 1 shows a side view of a conventional heat pipe.

Reference will now be made in detail to the preferred embodiments of the present invention, examples of which are illustrated in the accompanying drawings. Wherever possible, the same reference numbers are used in the drawings and the description to refer to the same or like parts.

Figure 2:
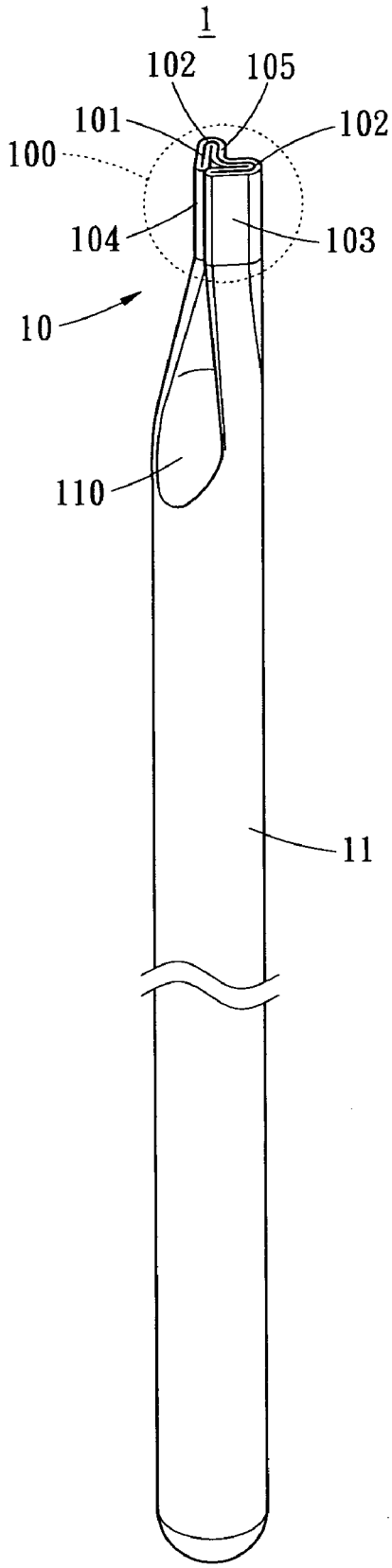
FIG. 2 shows a perspective view of a heat pipe having a sealing structure provided by the present invention.

Referring to FIG. 2, a perspective view of a sealing structure provided by the present invention is illustrated. The heat pipe 1 includes an open end 10 to be sealed by the sealing structure, such that the interior of the heat pipe is air-tight, and the working fluid can properly perform phase transition, allowing a normal operation of the heat pipe.

To prepare the sealing structure, the open end 10 of the heat pipe 1 is processed as follows.

Figure 3:
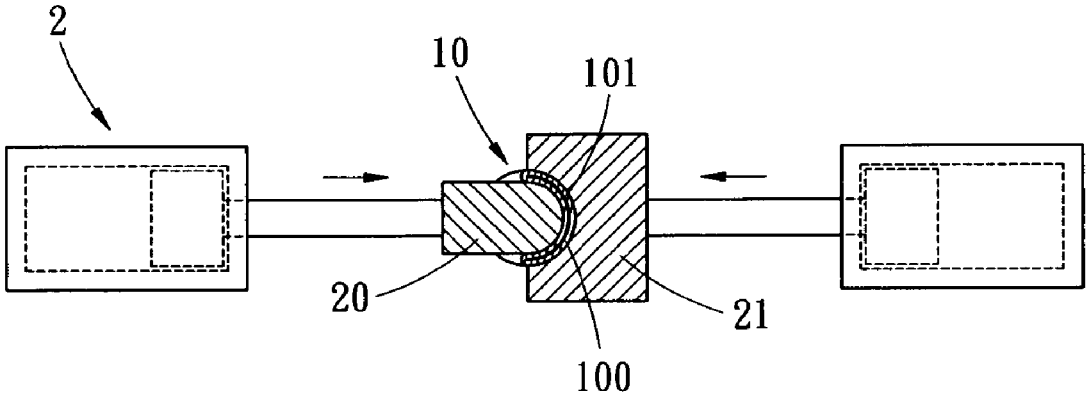
FIG. 3 shows a top view of the sealing structure.
Figure 4:
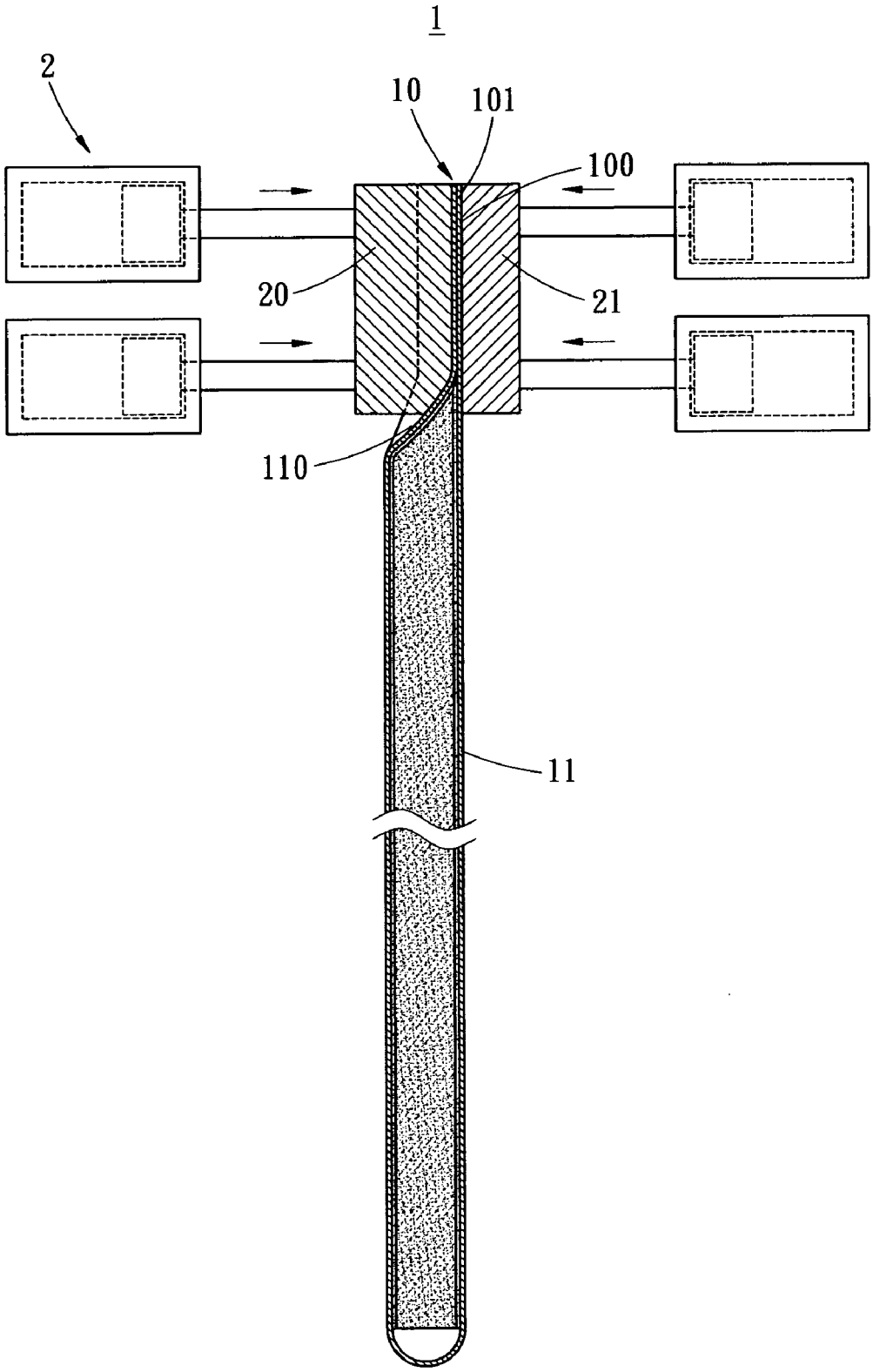
FIG. 4 shows a top view a press module for flattening the open end of the heat pipe at a first stage.
Figure 5:
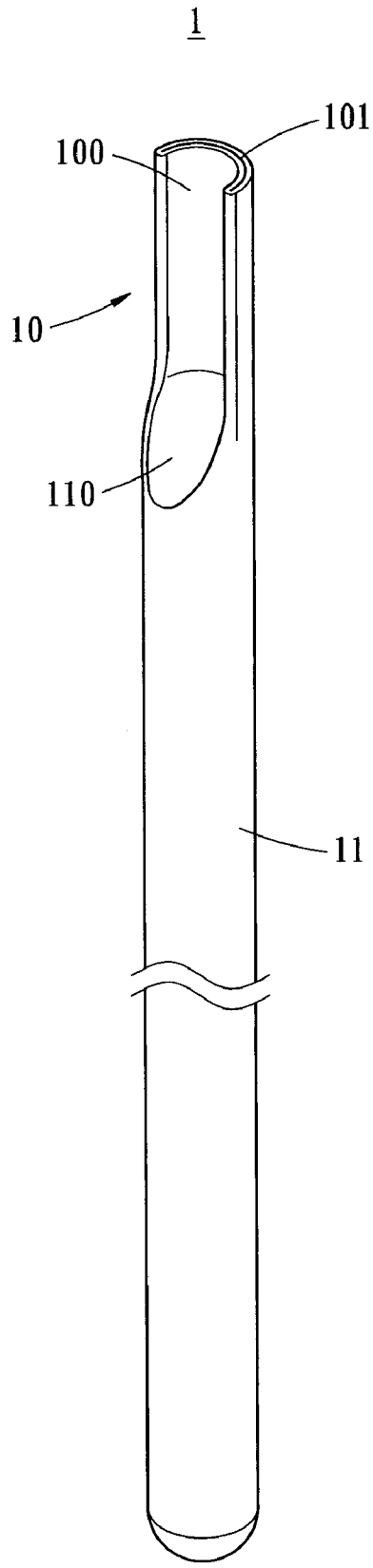
FIG. 5 shows a perspective view of the heat pipe after the first stage.

As shown in FIGS. 3 and 4, the open end 10 of the heat pipe 1 is disposed in a press module 2 which includes a first mold 20 and a second mold 21. The first mold 20 has a convex semi-circular contact, while the second mold 21 has a concave semi-circular contact. Therefore, by placing the open end 10 of the vertically extending heat pipe between the first mold 20 and the second mold 21 and pressing the first mold 20 towards the second mold 5, one half of the sidewall at the open end 10 is pressed towards the other half of the sidewall. As shown in FIG. 5, the open end 10 is pressed into a shape with a double-layered semi-circular cross section.

Thereby, a recess portion 100 is formed at the half sidewall that has been pressed towards the other half, and a bent sidewall 110 is formed between the pressed open end 10 and the bulk body of the heat pipe 1. Preferably, these two half sidewall walls are spaced from each other by a narrow curved slit 101 as shown in FIG. 5.

Figure 6:
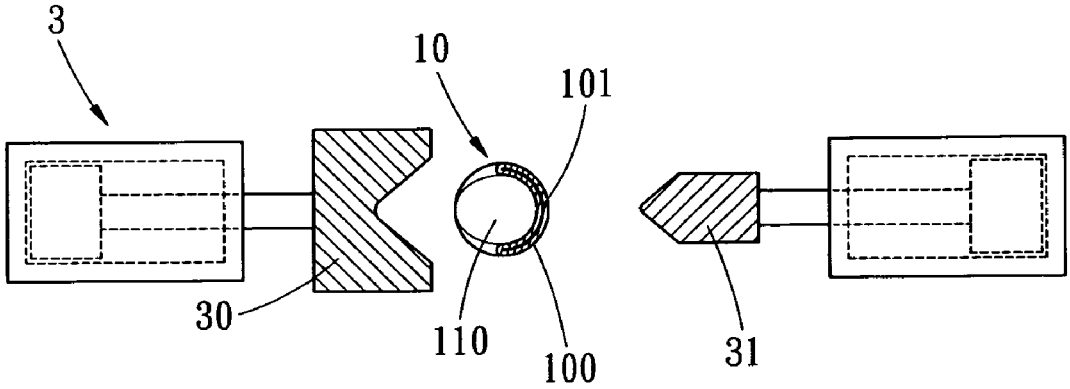
FIGS. 6 to 8 show top views of another press module for flattening the open end of the heat pipe at a second stage.
Figure 7:
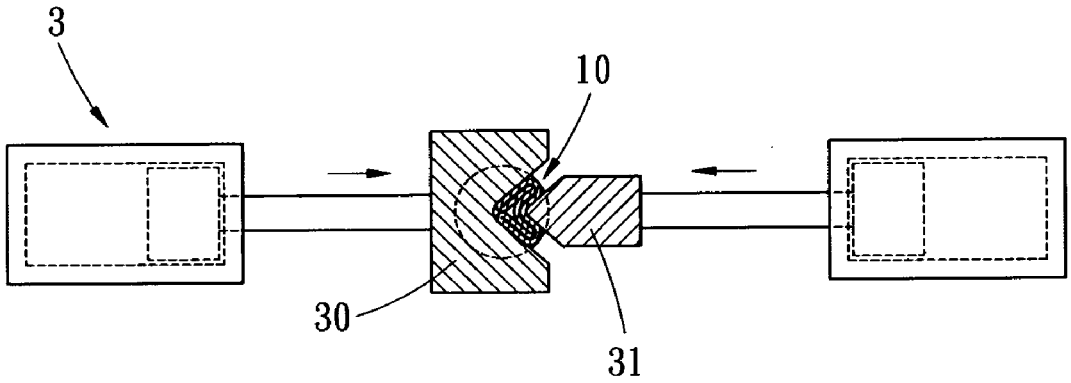

As shown in FIGS. 6-7, the heat pipe 1 as shown in FIG. 5 is further placed in a press module 3. Similarly, the heat pipe 1 extends vertically, while the pressed open end 10 is placed between a first mold 30 and a second mold 31. Preferably, the first mold 30 has a recessed triangular contact, while the second mold 331 has a protruding triangular contact. The convex portion of the open end 10 is placed towards the second mold 31, while the concave portion of the open end 10 is facing the first mold 30 when the first and second molds 30 and 31 are pressed against each other. As a result, the open end 10 is processed into a sealing structure that has a double-layered arrowhead cross section as shown in FIG. 7.

Figure 8:
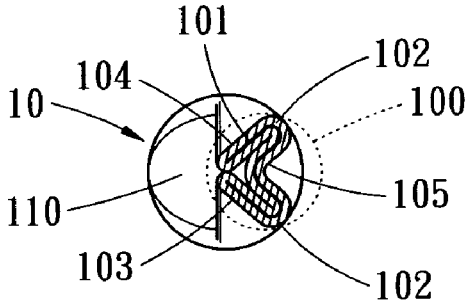

As shown in FIGS. 2 and 8, the sealing structure can be divided into a first flattened portion 103 and a second flattened portion 104 inclined with each other. The first and second flattened portions 103 and 104 each has one end in abutting contact with each other and the other end connected to a bent third flattened portion 105 at the bending point 102.

In this embodiment, the second mold 31 of the press module 3 has a protruding triangular contact, such that the third flattened portion 105 is bent into two portions towards the first and second flattened portions 103 and 104, respectively. When the second mold 31 is in the form of a flat contact, a sealing structure with a triangular cross section will be formed instead.

Figure 9:
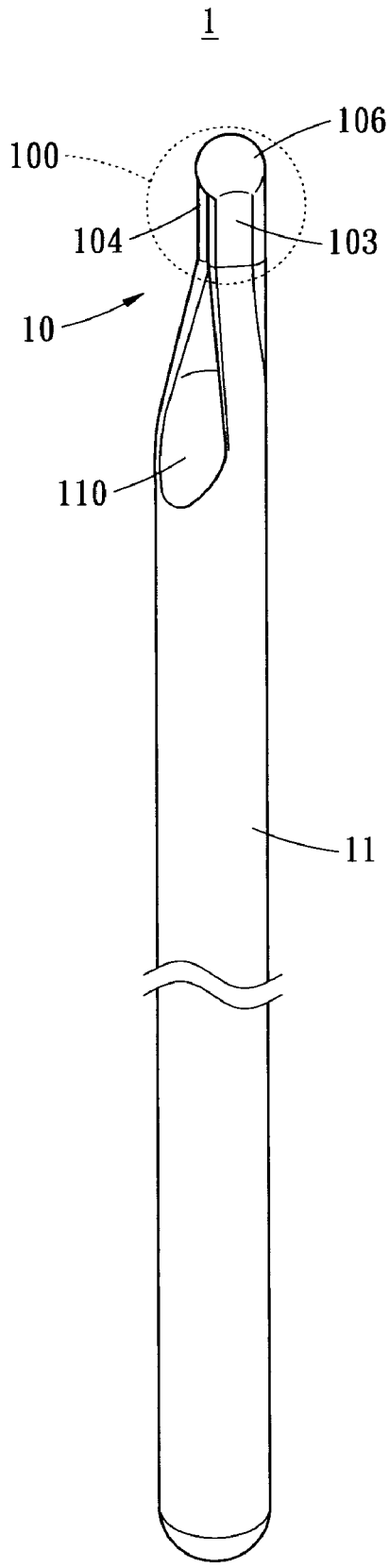
FIG. 9 shows a perspective view of the heat pipe after the second stage.

As shown in FIG. 9, when the heat pipe 1 is processed as shown in FIG. 2 or FIG. 8, the narrow slit 101 at the pressed sidewall portion 100 can be sealed by forming a covering portion 106 by brazing, soldering or welding. Therefore, the air-tightness of the heat pipe 1 can be ensured.

Figure 10:
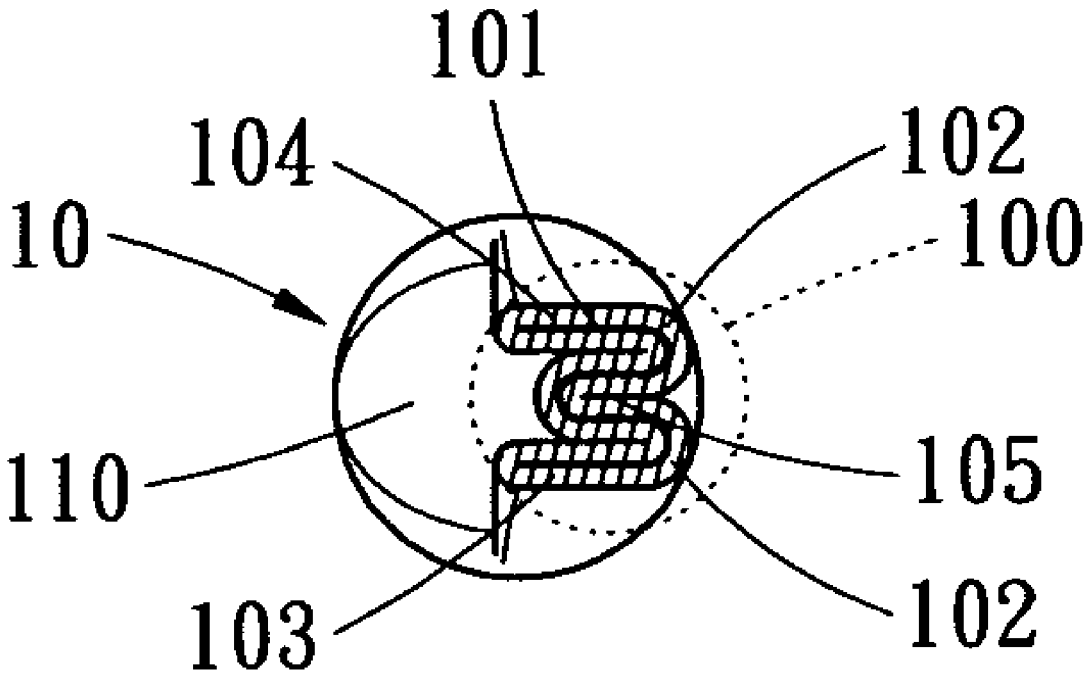
FIG. 10 shows a cross sectional view of a modification the sealing structure.

Further, as shown in FIG. 10, the open end 10 as shown in FIGS. 2 and 8 can be further processed. That is, the bending portions 102 of both the first and second flattened portions 103 and 104 can be pressed towards each other to form a sealing structure with a W-shape cross section.

Accordingly, the sealing structure provided by the present invention has at least the following advantages.

1. Without the thermal shrinking process, the open end can be sealed with a smaller cross section. Therefore, the problems of the conventional structure are resolved, the cost is reduced, and the quality is enhanced.

2. As the open end is pressed with a smaller cross section, the time spent on soldering process is shortened.

This disclosure provides exemplary embodiments of the present invention. The scope of this disclosure is not limited by these exemplary embodiments. Numerous variations, whether explicitly provided for by the specification or implied by the specification, such as variations in shape, structure, dimension, type of material or manufacturing process may be implemented by one of skill in the art in view of this disclosure.

What is claimed is:

1. A shrinkage-free sealing structure of a heat pipe, comprising:

a cylindrical bulk body including a pressed open end with a first side thereof being pressed towards the second side thereof, and a bent sidewall formed between the pressed open end and the bulk body; and a double-layered structure formed on the pressed open end, including a first and a second flattened portions connected to a third flattened portion at two ends thereof by a bending portion, respectively and the third flattened portion is bent into two portions to contact the first and the second flattened portions, respectively, wherein the double-layered structure has an arrowhead cross section.

2. The sealing structure of claim 1, wherein the double-layered structure has a narrow slit therein.

3. The sealing structure of claim 2, further comprising a covering portion sealing the narrow slit.

4. The sealing structure of claim 3, wherein the covering portion is formed by brazing, soldering or welding.

5. The sealing structure of claim 1, wherein the bending portions connected between the third flattened portion and both the first and the second flattened portions are pressed towards each other so that the double-layered structure has a W-shape cross section.

* * * * *